US007568941B2

(12) United States Patent
Tai et al.

(10) Patent No.: US 7,568,941 B2
(45) Date of Patent: Aug. 4, 2009

(54) CONNECTOR AND HOUSING THEREOF

(75) Inventors: Yu-Yuan Tai, Taoyuan Hsien (TW); Yun Zuo, Taoyuan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 0 days.

(21) Appl. No.: 11/898,726

(22) Filed: Sep. 14, 2007

(65) Prior Publication Data

US 2008/0146057 A1 Jun. 19, 2008

(30) Foreign Application Priority Data

Dec. 18, 2006 (TW) ..... 95147378 A

(51) Int. Cl.
*H01R 3/00* (2006.01)

(52) U.S. Cl. ..... 439/490

(58) Field of Classification Search ..... 439/490
See application file for complete search history.

(56) References Cited

U.S. PATENT DOCUMENTS 5,924,889 A * 7/1999 Wang ..... 439/490
6,116,946 A * 9/2000 Lewis et al. ..... 439/490
6,174,194 B1 * 1/2001 Bleicher et al. ..... 439/490
6,325,664 B1 * 12/2001 Someda et al. ..... 439/490
6,425,781 B1 * 7/2002 Bernstein et al. ..... 439/490
6,431,906 B1 * 8/2002 Belopolsky ..... 439/490
6,478,610 B1 * 11/2002 Zhou et al. ..... 439/490
6,478,611 B1 * 11/2002 Hyland ..... 439/490
2002/0177354 A1 * 11/2002 Sato et al. ..... 439/490
2003/0148654 A1 * 8/2003 Kan ..... 439/490

* cited by examiner

*Primary Examiner*—Ross N Gushi
(74) *Attorney, Agent, or Firm*—Birch, Stewart, Kolasch & Birch, LLP

(57) ABSTRACT

A connector and the housing thereof, which is equipped with at least one light emitting element having at least one lead, are disclosed. The connector includes at least one connecting base, at least one light emitting element, and a housing. The housing covers at least a portion of the connecting base and has a body and at least one fastening structure. The light emitting element is accommodated in the body, and the fastening structure is connected with the body and fastens the lead of the light emitting element so as to connect and fix the light emitting element with the body.

14 Claims, 3 Drawing Sheets

A

CONNECTOR AND HOUSING THEREOF

CROSS REFERENCE TO RELATED APPLICATIONS

This Non-provisional application claims priority under 35 U.S.C. §119(a) on Patent Application No. 095147378, filed in Taiwan, Republic of China on Dec. 18, 2006, the entire contents of which are hereby incorporated by reference.

BACKGROUND OF THE PRESENT INVENTION

1. Field of Invention

The present invention relates to a connector and a housing thereof, and more particularly to a connector and a housing thereof equipped with a light emitting element.

2. Related Art

With rapid development of information technology, the applications of computers have become widespread. Since computers connect with the Internet and rapid development of network technology, people can quickly obtain the required information from the Internet or provide a variety of information services to others. Therefore, it has become a trend of the information era to connect computers or peripheral devices with the network.

In the prior art, the network and various kinds of conventional connectors are used to link electronic devices distributed at different places for signal and information exchanges. As shown in FIG. 1, a conventional connector 1 is made by combination of a housing 12 and four connecting bases 11. Each connecting base 11 has a jack 111 and a plurality of terminals 112 embedded in the jack 111. The jack 111 allows a plug 101 of at least one external connecting wire 10 to be inserted in for performing signal transmission. Both the jack 111 and the plug 101 have to satisfy a standard requirement.

In order to display different operation states of the network or electronic device connected with the connector 1, the connector 1 is equipped with several light emitting diodes (LED) 13, respectively disposed in the housing 12 corresponding to the connecting bases 11 so as to indicate the operation of each corresponding connecting bases 11 for identification. During the assembly process of the LEDs 13 and the housing 12, the housing 12 has several sliding slots 121 for respectively allowing several leads 131 of the LEDs 13 to slide until appropriate positions. Afterwards, the glue 14 is dispensed around the leads 131, and then the glue 14 is cured by baking so that the step of fixing the leads 131 to the housing 12 is completed.

However, once, only one or several LEDs 13 is out of functions, or the housing 12 is out of order during testing the assembled connector 1 with the LEDs 13, the entire connector 1 has to be thrown away. Therefore, the production cost is increased. Moreover, the glue-dispensing and baking steps not only lower the production efficiency and increase working hour, but also raise the risk of defective rate of products due to mistakes caused by manual glue dispensing.

SUMMARY OF THE PRESENT INVENTION

The present invention provides a connector and a housing thereof that can raise the production efficiency and yield, and lower the production cost.

A housing of a connector according to the present invention which the connector is equipped with at least one light emitting element. The light emitting element has at least one lead. The housing includes a body and at least one fastening structure. The light emitting element is accommodated in the body. The fastening structure is connected with the body and fastens the lead of the light emitting element so as to connect and fix the light emitting element with the body.

A connector according to the present invention includes at least one light emitting element and a housing. The light emitting element has at least one lead. The housing has a body and at least one fastening structure. The light emitting element is accommodated in the body. The fastening structure is connected with the body and fastens the lead of the light emitting element so as to connect and fix the light emitting element with the body.

As mentioned above, a connector and the housing thereof according to the present invention utilize a fastening structure for fastening the leads of the light emitting element to the housing. In comparison with the prior art, the present invention avoids the steps of glue dispensing and baking for fixing the leads of the light emitting element to the housing. This can not only simplify the assembly between the light emitting elements and the housing, but also decrease the risk of defective rate of products due to mistakes caused by manual glue dispensing. As the results, the production efficiency and yield can be effectively raised, and also the production cost is lowered. Moreover, if rework is required after testing, the light emitting elements can be readily separated from the housing by simply releasing the fastening state between the fastening structure and the lead of the light emitting element. Thus, the operation of rework is facilitated.

BRIEF DESCRIPTION OF THE DRAWINGS

The present invention will become more fully understood from the detailed description given herein below illustration only, and thus is not limitative of the present invention, and wherein.

DETAILED DESCRIPTION OF THE PRESENT INVENTION

The present invention will be apparent from the following detailed description, which proceeds with reference to the accompanying drawings, wherein the same references relate to the same elements.

Figure 1:
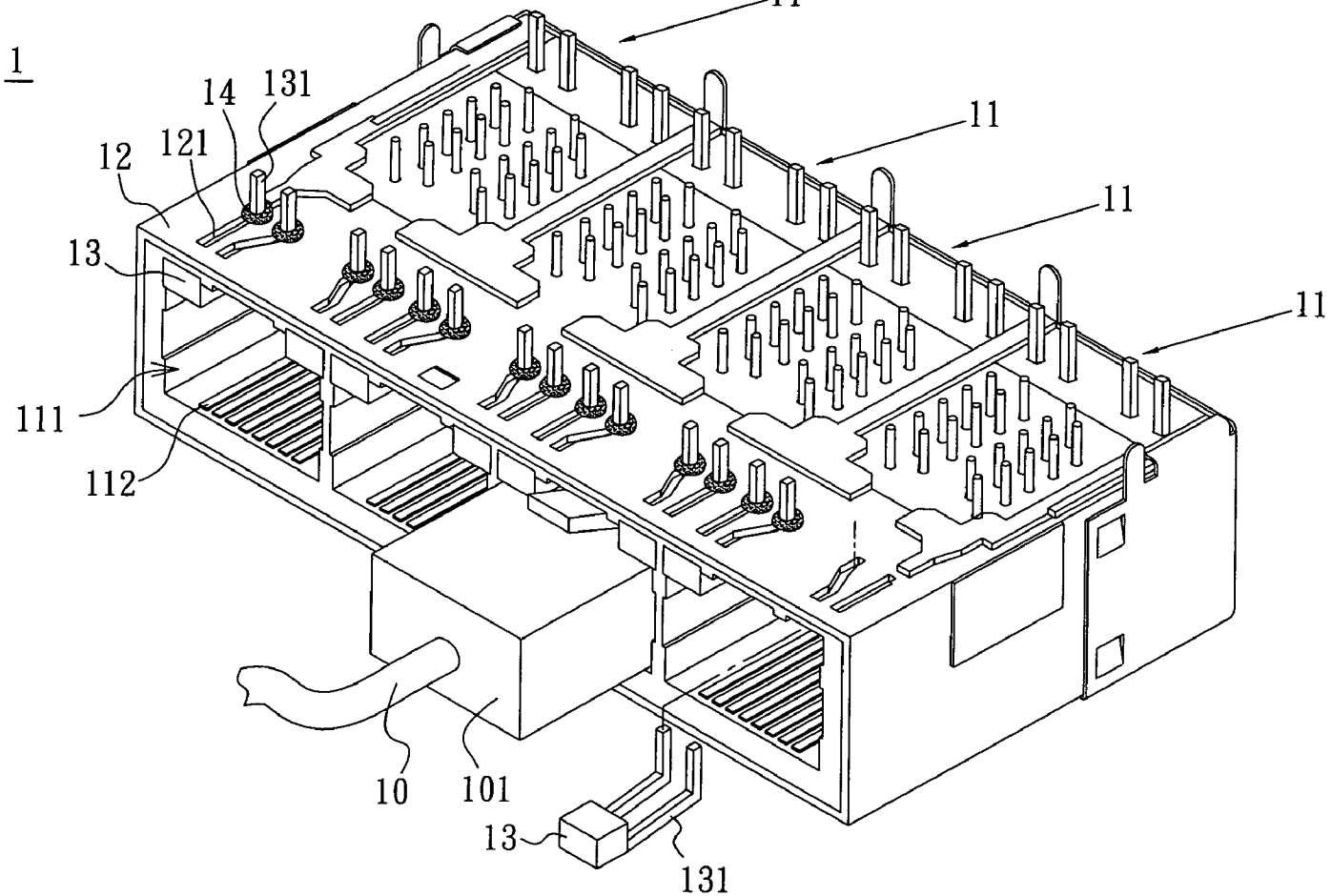
FIG. 1 (PRIOR ART)
FIG. 1 is a schematic diagram showing a conventional connector.
Figure 2:
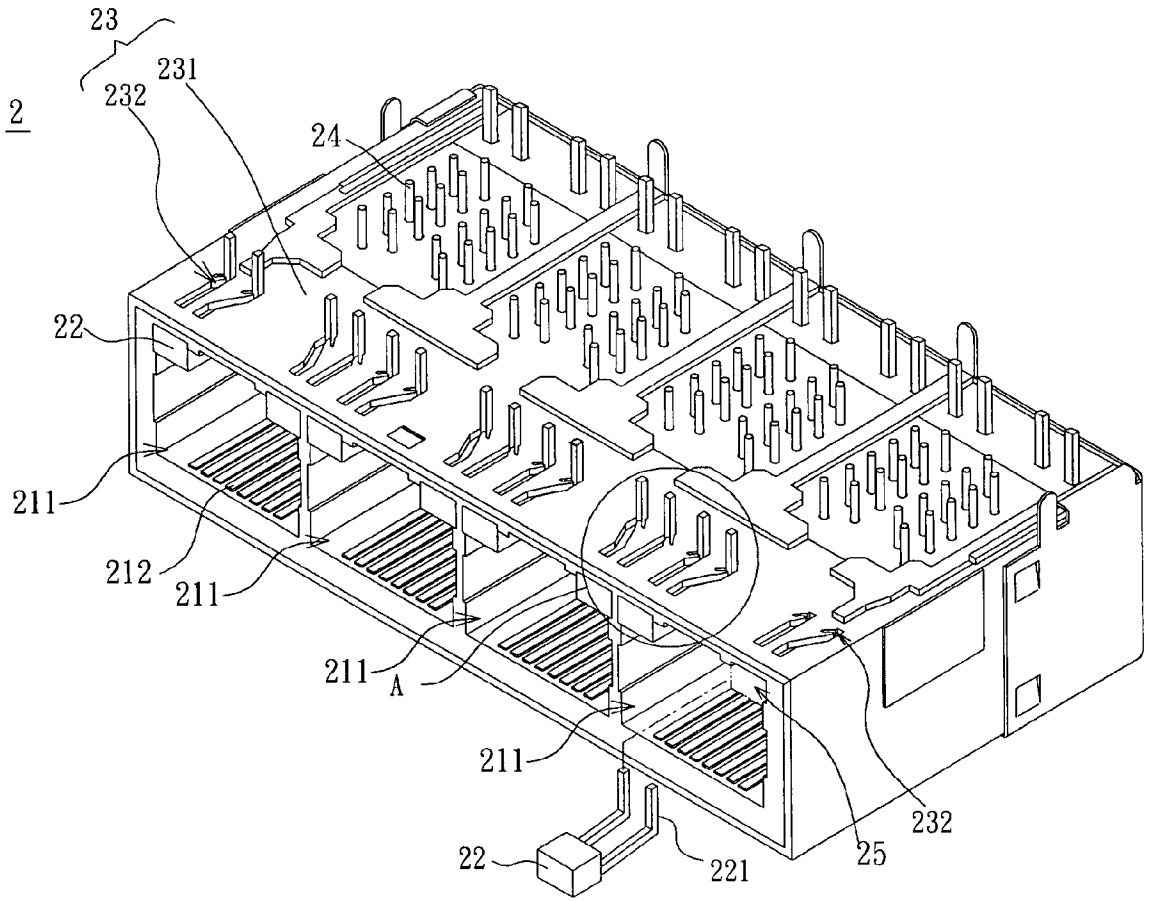
FIG. 2 is a schematic diagram showing a connector according to a preferred embodiment of the present invention.
Figure 3:
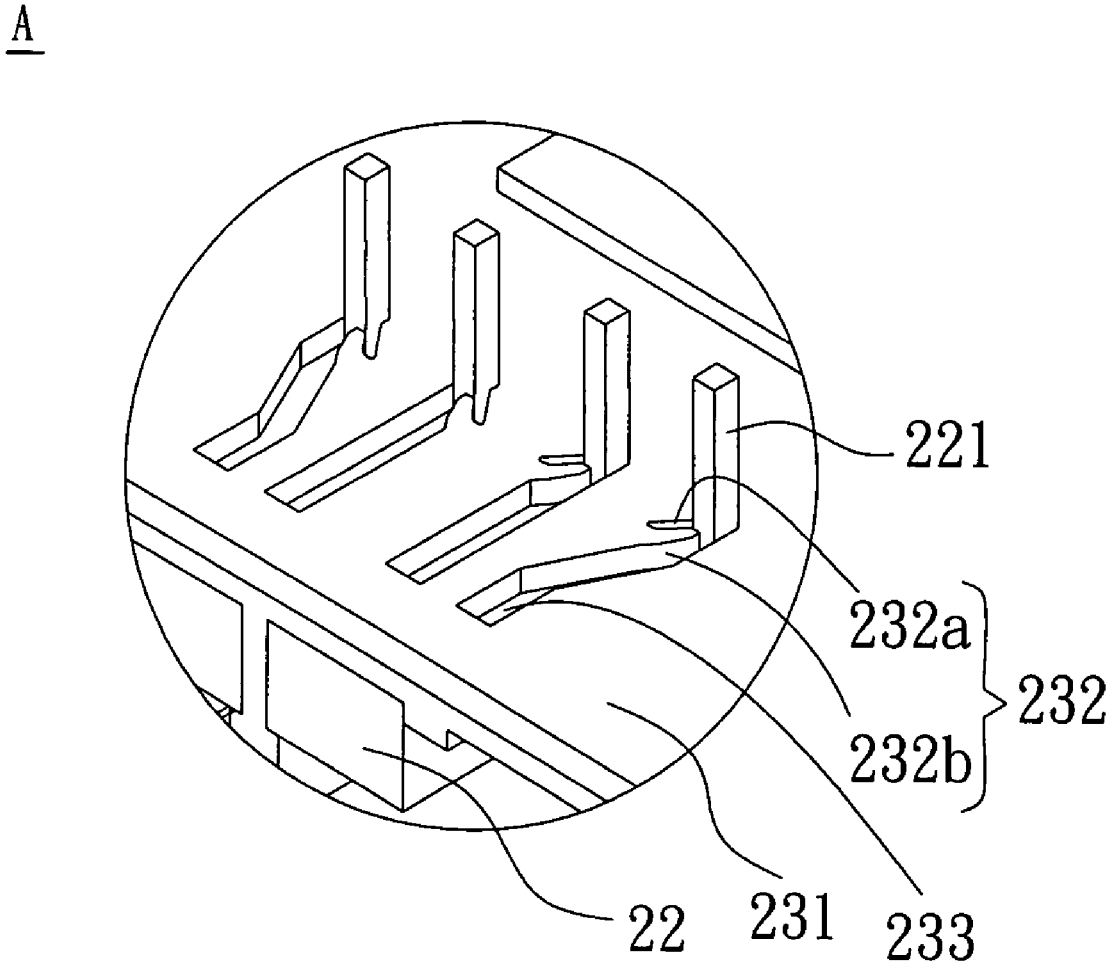
FIG. 3 is an enlarged diagram of part A in FIG. 2.

Please refer to FIGS. 2 and 3, a connector 2 according to a preferred embodiment of the present invention includes at least one light emitting element 22 and a housing 23. In this embodiment, the connector 2 can be an RJ-11 connector, an RJ-12 connector, an RJ-45 connector or a USB connector. In this embodiment, the connector 2 further includes at least one receiving hole 211 and a plurality of terminals 212.

The connector 2 in this embodiment includes four receiving hole 211 and four light emitting elements 22, as an example. However, the amount of receiving hole 211 and the light emitting elements 22 can not be limited to this example. It can be changed according to practical requirement. The terminals 212 are embedded in the receiving hole 211 for allowing a plug (not shown) of an external connecting wire to be connected and coupled with. Also, the housing 23 has a plurality of pins 24 electrically connected with the terminals 212, so that when the plug of the external connecting wire is inserted into the receiving hole 211 and the plug is coupled with the terminals 212, the connector 2 performs signal transmission with an external system (not shown) through the terminals 212.

The housing 23 has a body 231 and at least one fastening structure 232. The body 231 covers at least a portion of the receiving hole 211. The fastening structure 232 is connected with the body 231. The fastening structure 232 can be integrally formed as a single piece with the body 231. In this embodiment, the fastening structure 232 is directly formed at one surface of the body 231. However, this is only an example and should not be used to restrict the present invention. The fastening structure 232 and the body 231 can be two separate components which are combined and connected with each other by adhering, wedging, locking or welding.

In this embodiment, the fastening structure 232 has a stopping hole 232*a* and a fastening part 232*b*. The fastening part 232*b* is disposed adjacent to the stopping hole 232*a*. More explicitly, the fastening part 232*b* is disposed along one side of the stopping hole 232*a*. The fastening part 232*b* can be elastically deformed, and the fastening part 232*b* is a protruding block or a hook.

The light emitting elements 22 are accommodated in the body 231 of the housing 23. Each light emitting element 22 has at least one lead 221. In this embodiment, each light emitting element 22 has two leads 221 as an example. The leads 221 pass through the sliding slots 233 of the housing 23 and can slide freely therein. The elastic deformation of the fastening part 232*b* fastens the lead 221 of the light emitting element 22 so that the light emitting element 22 can be fastened to the body 231 of the housing 23. The leads 221 of the light emitting element 22 are disposed corresponding to the positions of the receiving hole 211. The light emitting elements 22 provide an indication function. For example, the light emitting elements 22 display and show the connecting state between the external connecting wires and the terminals 212. Besides, the body 231 in the circumference of receiving hole 211 is formed with at least one opening 25 for exposing a portion of the light emitting element 22 so that the lights emitted from the light emitting element 22 can be exhausted outside. The light emitting element 22 can be a light emitting diode (LED), an organic electroluminescent device (OLED) or a laser diode (LD).

In summary, a connector and the housing thereof according to the present invention utilize a fastening structure for fastening the leads of the light emitting element to the housing. In comparison with the prior art, the present invention avoids the steps of glue dispensing and baking for fixing the leads of the light emitting element to the housing. This can not only simplify the assembly between the light emitting elements and the housing, but also decrease the risk of defective rate of products due to mistakes caused by manual glue dispensing. As the results, the production efficiency and yield can be effectively raised, and also the production cost is lowered. Moreover, if rework is required after testing, the light emitting elements can be readily separated from the housing by simply releasing the fastening state between the fastening structure and the lead of the light emitting element. Thus, the operation of rework is facilitated.

Although the present invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the present invention.

What is claimed is:

1. A housing of a connector, which is equipped with at least one light emitting element having at least one lead, the housing comprising:

a body accommodating the light emitting element; and at least one fastening structure connected with the body and fastening the lead of the light emitting element so as to connect and fix the light emitting element with the body, wherein the fastening structure has a stopping hole and a fastening part, and the fastening part is elastically deformed and disposed adjacent to the stopping hole for fastening the lead of the light emitting element at the stopping hole.

2. The housing of claim 1, wherein the fastening structure and the body are integrally formed as a single piece.

3. The housing of claim 1, wherein the fastening part is a protruding block or a hook.

4. The housing of claim 1, wherein the body has at least one opening exposing a portion of the light emitting element so that a light emitted from the light emitting element can be exhausted outside.

5. The housing of claim 1, wherein the light emitting element is a light emitting diode (LED), an organic electroluminescent device (OELD) or a laser diode (LD).

6. A connector, comprising:

at least one light emitting element having at least one lead; and a housing having a body and at least one fastening structure, wherein the light emitting element is accommodated in the body, and the fastening structure is connected with the body and fastens the lead of the light emitting element, wherein the fastening structure has a stopping hole and a fastening part, and the fastening part is elastically deformed and disposed adjacent to the stopping hole for fastening the lead of the light emitting element at the stopping hole.

7. The connector of claim 6, wherein the fastening structure and the body are integrally formed as a single piece.

8. The connector of claim 6, wherein the fastening part is a protruding block or a hook.

9. The connector of claim 6, further comprising at least one receiving hole and a plurality of terminals embedded in the receiving hole so that a plug of an external connecting wire can be inserted and coupled with the terminals.

10. The connector of claim 9, wherein the housing further has a plurality of pins, the pins of the housing are electrically connected with the terminals so that the connector performs signal transmission with an external system through the terminals when the plug of the external connecting wire is inserted and coupled with the terminals.

11. The connector of claim 6, wherein the lead of the light emitting element are disposed corresponding to the position of the receiving hole, and the light emitting element provides an indication function.

12. The connector of claim 6, wherein the body has at least one opening exposing a portion of the light emitting element so that a light emitted from the light emitting element can be exhausted outside.

13. The connector of claim 6, wherein the connector is an RJ-11 connector, an RJ-12 connector, an RJ-45 connector or a USB connector.

14. The connector of claim 6, wherein the light emitting element is a light emitting diode (LED), an organic electroluminescent device (OELD) or a laser diode (LD).

* * * * *